US006658797B2

(12) United States Patent
Jones

(10) Patent No.: US 6,658,797 B2
(45) Date of Patent: Dec. 9, 2003

(54) ANTENNA SUPPORT STRUCTURE WITH PALM TREE SKIRT

(75) Inventor: Douglas Jones, Palm Springs, CA (US)

(73) Assignee: Absolute Stealth Ltd., Napa, CA (US)

( * ) Notice: Subject to any disclaimer, the term of this patent is extended or adjusted under 35 U.S.C. 154(b) by 0 days.

(21) Appl. No.: 10/061,870

(22) Filed: Jan. 31, 2002

(65) Prior Publication Data

US 2002/0184833 A1 Dec. 12, 2002

Related U.S. Application Data

(60) Provisional application No. 60/265,021, filed on Jan. 31, 2001.

(51) Int. Cl.[7] ..... E04H 12/00; H01Q 1/12; F41H 3/00

(52) U.S. Cl. ..... 52/40; 52/651.07; 343/890; 428/18

(58) Field of Search ..... 52/40, 651.07; 343/890; 428/18

(56) References Cited

U.S. PATENT DOCUMENTS

| | | | |
|---|---|---|---|
| 843,171 | A | 2/1907 | Petterson |
| 2,099,671 | A | 11/1937 | Bairey |
| 2,251,705 | A | 8/1941 | Gonzalez |
| 2,698,873 | A | 1/1955 | Allsworth et al. |
| 2,851,807 | A | 9/1958 | Taylor |
| 3,144,375 | A | 8/1964 | Day |
| 3,210,232 | A | 10/1965 | Wielland |
| 3,614,727 | A | 10/1971 | Fritts |
| 3,829,349 | A | 8/1974 | Hermanson |
| 4,068,419 | A | 1/1978 | Decoppet |
| 4,855,167 | A | 8/1989 | Biehl |
| 5,085,900 | A | 2/1992 | Hamlett |
| D340,003 | S | 10/1993 | Wright et al. |
| 5,340,622 | A | 8/1994 | Curitti |
| 5,412,892 | A | 5/1995 | Filippakis |
| 5,611,176 | A | 3/1997 | Juengert et al. |

(List continued on next page.)

FOREIGN PATENT DOCUMENTS

| | | | | |
|---|---|---|---|---|
| DE | 2944931 A1 | | 5/1979 | |
| DE | 2923280 A1 | | 11/1980 | |
| EP | 1024550 | * | 8/2000 | H01Q/1/12 |
| EP | 1124278 | * | 11/2000 | H01Q/1/12 |
| EP | 1089376 | * | 4/2001 | H01Q/1/12 |
| GB | 2325569 | * | 11/1998 | H01Q/1/12 |
| GB | 2333645 | * | 7/1999 | H01Q/1/12 |
| JP | 2000-151234 | * | 5/2000 | H01Q/1/12 |
| JP | 2001-317229 | * | 11/2001 | E04H/12/00 |
| WO | 01/15263 | * | 3/2001 | H01Q/1/12 |

OTHER PUBLICATIONS 3 page from http://www.alandick.com/pages/enviro/cellular_trees.html found on internet May 2, 2003.*

*Primary Examiner*—Robert Canfield
(74) *Attorney, Agent, or Firm*—Denton L. Anderson; Sheldon & Mak

(57) ABSTRACT

An antenna support structure has the outward appearance of a palm tree. The antenna support structure has a vertical support pole with an upper portion, an intermediate portion and a lower portion. The lower portion is of a color and texture to resemble the trunk of a palm tree. Disposed outwardly from the intermediate portion is a plurality of antenna receptor members appropriately configured to receive desired electromagnetic signal waves. At the top of the support pole is a plurality of green members having the appearance of new palm fronds. Below the green members are a plurality of drooping members disposed downwardly about the intermediate portion of the support pole and covering the antenna receptor members. The drooping members have colors and textures to resemble a palm tree skirt.

11 Claims, 15 Drawing Sheets

U.S. PATENT DOCUMENTS

| | | | | |
|---|---|---|---|---|
| 5,755,050 | A | 5/1998 | Aiken | |
| 5,787,649 | A | 8/1998 | Popowych et al. | |
| 5,953,840 | A | 9/1999 | Simson et al. | |
| 6,028,566 | A | 2/2000 | Pennell et al. | |
| 6,038,800 | A | 3/2000 | Seidel | |
| 6,055,753 | A | 5/2000 | Sondericker, III | |
| 6,060,993 | A | 5/2000 | Cohen | |
| 6,122,866 | A | 9/2000 | Thomas et al. | |
| 6,224,953 | B1 | 5/2001 | Johnson | |
| 6,286,266 | B1 * | 9/2001 | Popowych et al. | 52/40 |
| 6,434,889 | B1 * | 8/2002 | Jones | 52/40 |

* cited by examiner 14
12
12
28
30

16

16
14
12
14

34
32

FIG. 15
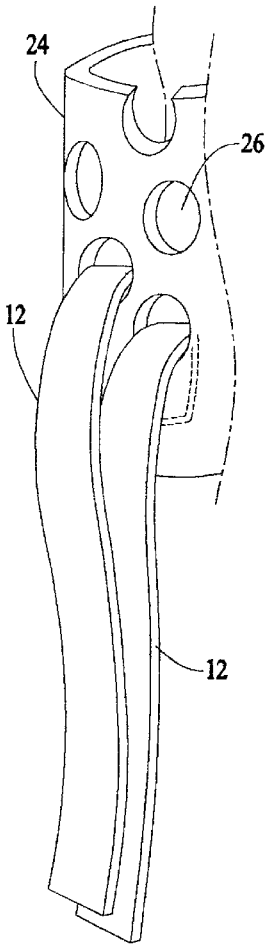
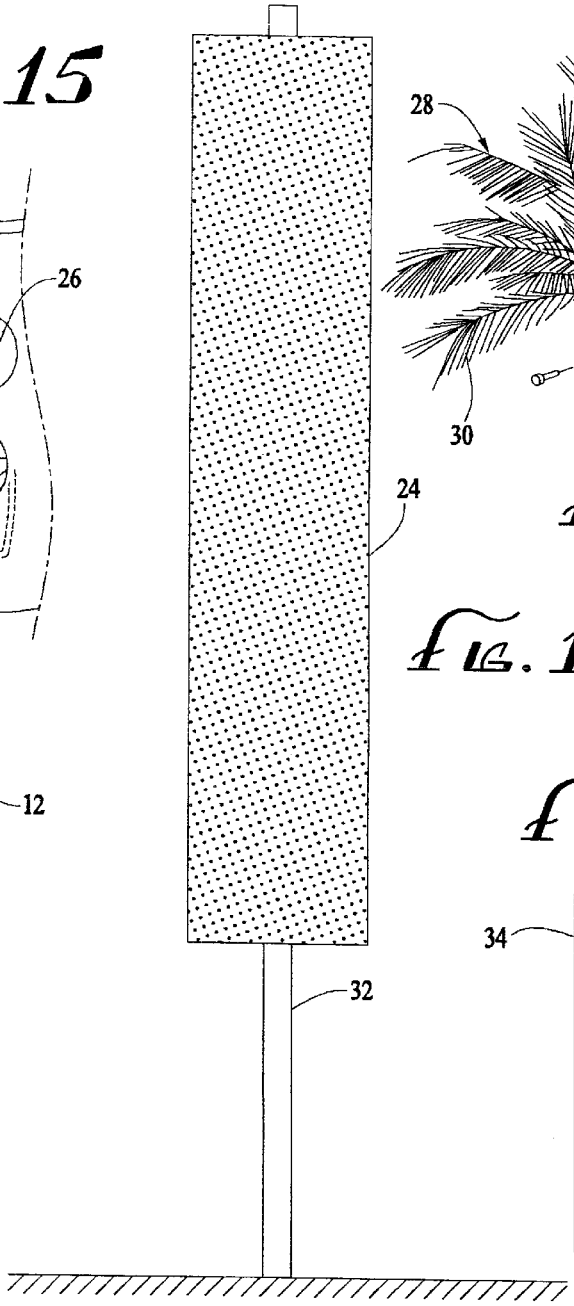
FIG. 12
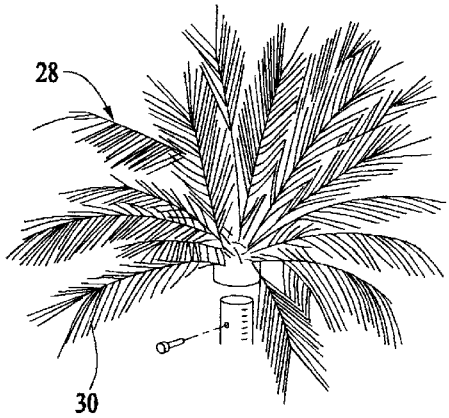
FIG. 13
FIG. 14
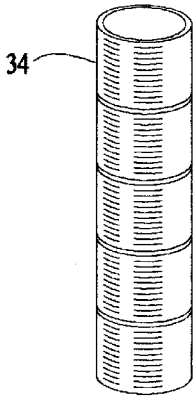

FIG. 27
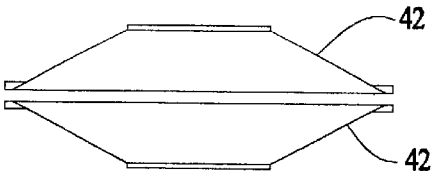
FIG. 28
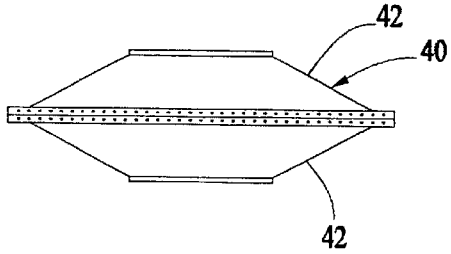
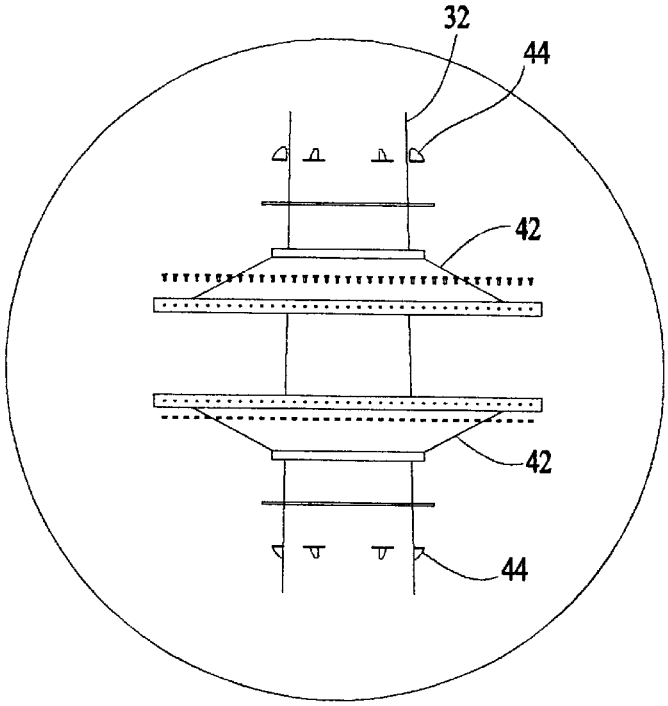
FIG. 29

ANTENNA SUPPORT STRUCTURE WITH PALM TREE SKIRT

RELATED APPLICATION

This application is related to, and claims priority from, provisional patent application Ser. No. 60/265,021, filed Jan. 31, 2001. The entirety of that application is incorporated herein by this reference.

FIELD OF THE INVENTION

This invention relates generally to antenna support structures and, more particularly, to antenna support structures intended to blend in with their surroundings.

BACKGROUND OF THE INVENTION

Antenna support structures are an increasingly common site in both rural and urban neighborhoods. To many, however, antenna support structures are unsightly and significantly detract from the appearance of the landscape.

Attempts have been made to minimize the problem by supporting a multiple of different antenna receptor members on a single support structure (so as to support multiple carriers and thereby minimize the number of support structures cluttering up the landscape). Such attempts at "co-location," however, have not addressed the fundamental problem regarding the perceived ugliness of the support structures themselves.

Attempts have been made to "disguise" antenna support structures as ordinary trees. However, such previous attempts have been largely unsuccessful. In most cases, the resulting appearance of the antenna support structure is unduly artificial and is, therefore, even more unsightly than an ordinary (undisguised) antenna support structure. In those limited cases where tree disguises provide a relatively authentic tree appearance, the structure is unduly complicated, expensive to build and expensive and awkward to maintain.

Also, such prior art attempts to "disguise" antenna support structures have not addressed the problem of how to provide such antenna support structures with multiple antenna receptor types, so as to allow the antenna support structure to support multiple carriers.

In my presently pending application Ser. No. 09/620,921, I proposed a design for a unique antenna support structure wherein the antenna has the appearance of a palm tree with the antenna receptor members disposed within a cover which simulates a palm tree skirt. The present application discloses new variations on that design.

DESCRIPTION OF THE DRAWINGS

These and other features, aspects and advantages of the present invention will become better understood with reference to the following description and accompanying drawings where:

FIG. 12 is a side view of a fifth antenna support structure having features of the invention;

FIG. 13 is an isometric view of a top portion useable in the support structure of FIG. 12;

FIG. 14 is an isometric view of a base cover useable in the support structure illustrated in FIG. 12;

FIG. 15 is an isometric view of a portion of the support structure illustrated in FIG. 12 showing how the drooping members are disposed through holes in the cylinder portion of the support structure;

FIG. 27 is a diagrammatic side view of the two moieties of the support member illustrated in FIG. 26;

FIG. 28 is a diagrammatic view of the fully assembled support member illustrated in FIG. 27;

FIG. 29 is an exploded side view of the support member illustrated in FIG. 26;

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

Figures 1, 2, 3, 4, 5, 6:
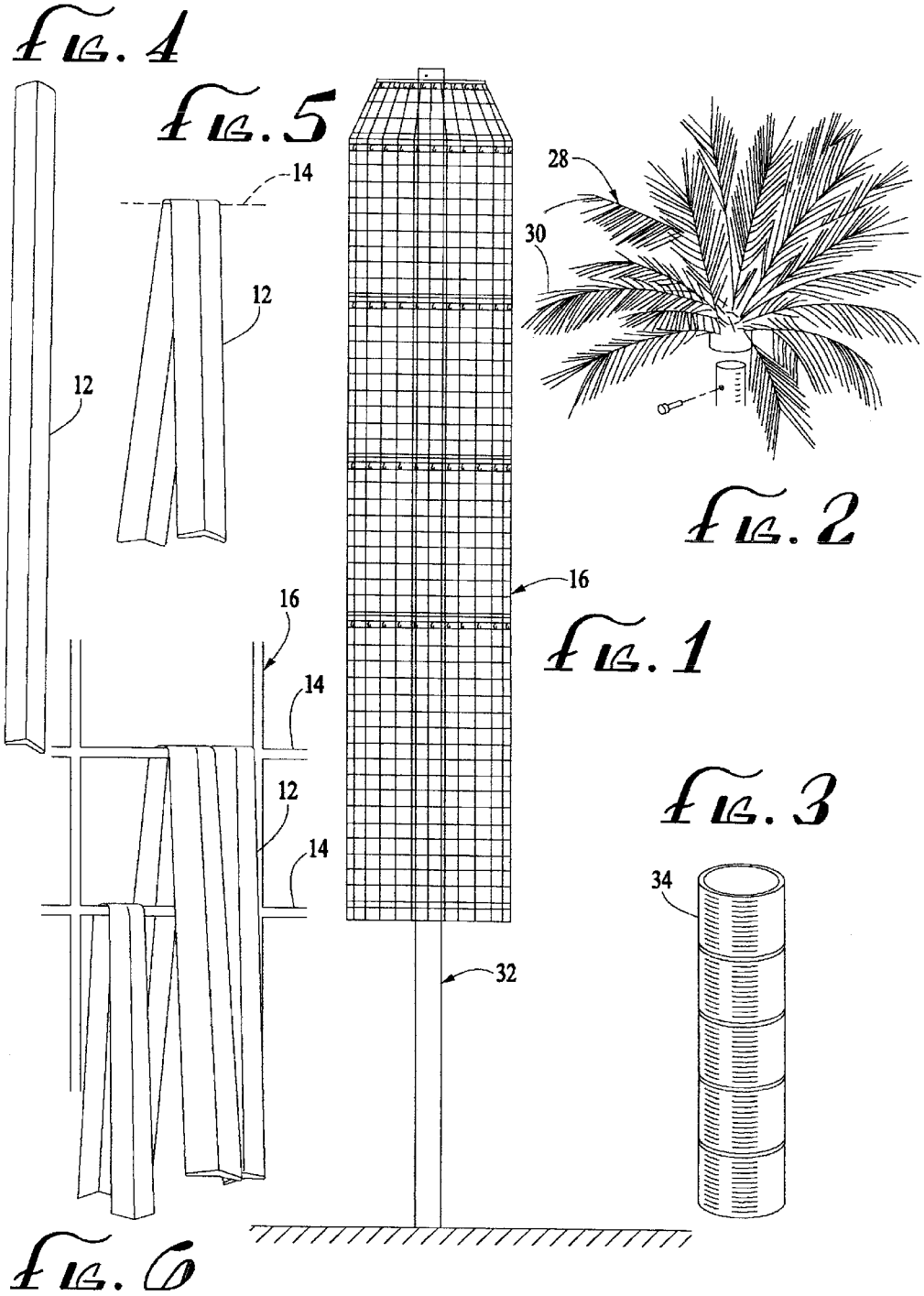
FIG. 1 is a side view of an antenna support structure having features of the invention.
FIG. 2 is an isometric view of a top portion useable in the support structure of FIG. 1.
FIG. 3 is an isometric view of a base cover useable in the support structure illustrated in FIG. 1.
FIG. 4 is a isometric view of a drooping member useable in the invention.
FIG. 5 is an isometric view of the drooping member illustrated in FIG. 4, showing the strip folded in half.
FIG. 6 is an isometric view of several drooping members of the type illustrated in FIG. 4, showing how such drooping members are hung on the netting of the support lattice of the support structure illustrated in FIG. 1.

As noted above, I presently have a pending application Ser. No. 09/620,921, the contents of which are incorporated herein, in its entirety, by this reference. FIGS. 1–6 illustrate a portion of an antenna support structure 10 having features similar to that which is disclosed and claimed in my presently-pending application, except that the drooping members 12 are now folded over horizontal portions 14 of the support lattice ("netting") 16 as illustrated in FIGS. 5 and 6. The drooping members 12 can be retained on the support lattice 16 by adhesives or by any appropriate mechanical fasteners.

Figure 7:
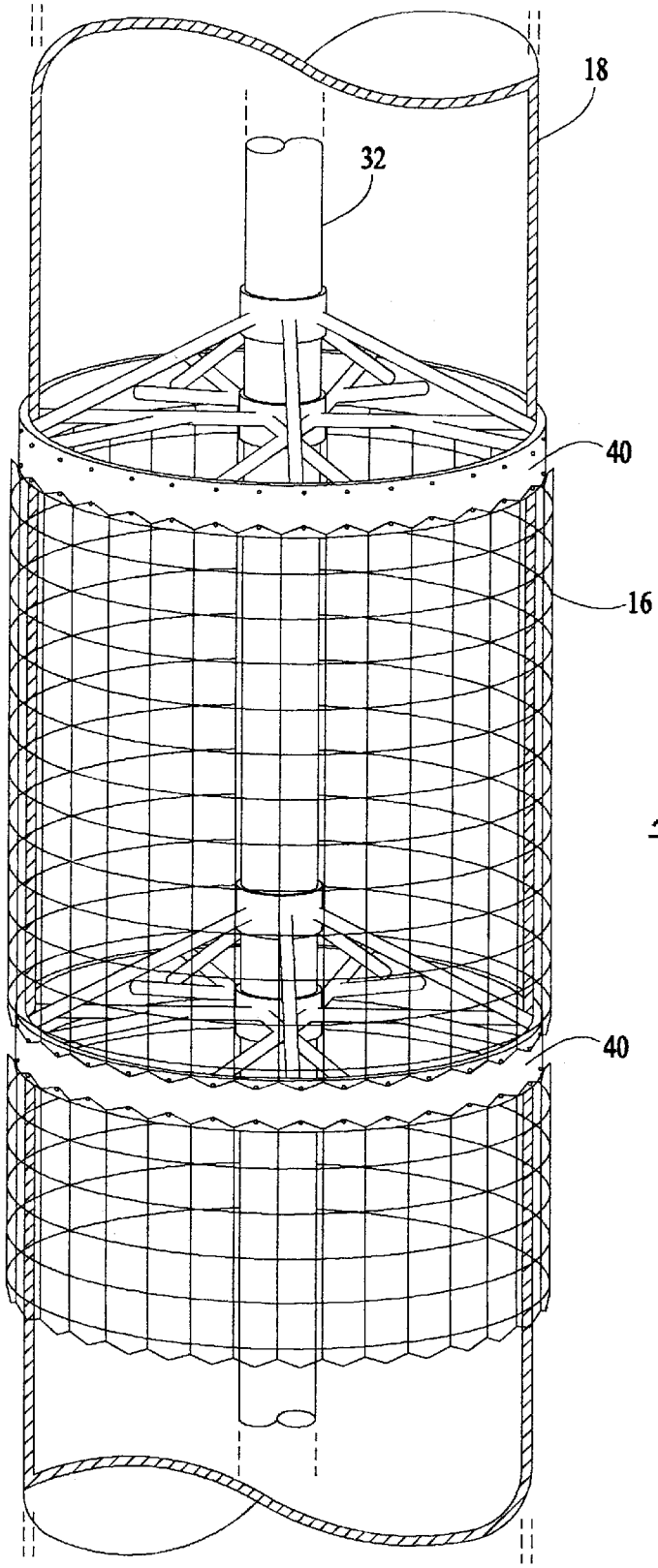
FIG. 7 is an isometric view of a section of a second support structure having features of the invention.

FIG. 7 illustrates a somewhat different embodiment. In this embodiment, a tube 18 is disposed inside the support lattice 16 and outside of the antenna receptor members 20. The tube 18 is made from a plastic or other material which is non-reflective of radio waves. In this embodiment, access to the antenna receptor members 20 must be from below the support lattice 16. This embodiment preserves the round configuration of the simulated palm tree skirt at all times, even in windy conditions. The tube 18 also prevents the support lattice 16 and the drooping members 12 from contacting the antenna receptor members 20.

Figure 8:
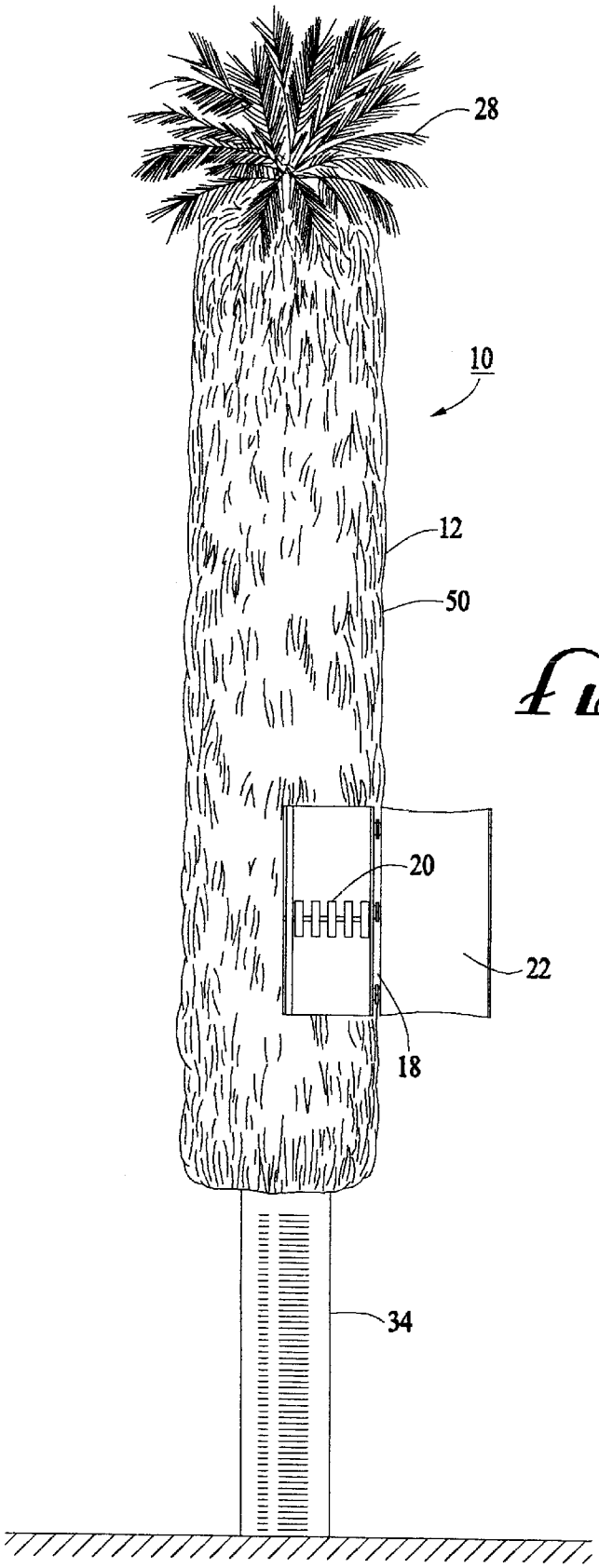
FIG. 8 is an isometric view of a third support structure having features of the invention.
Figure 9:
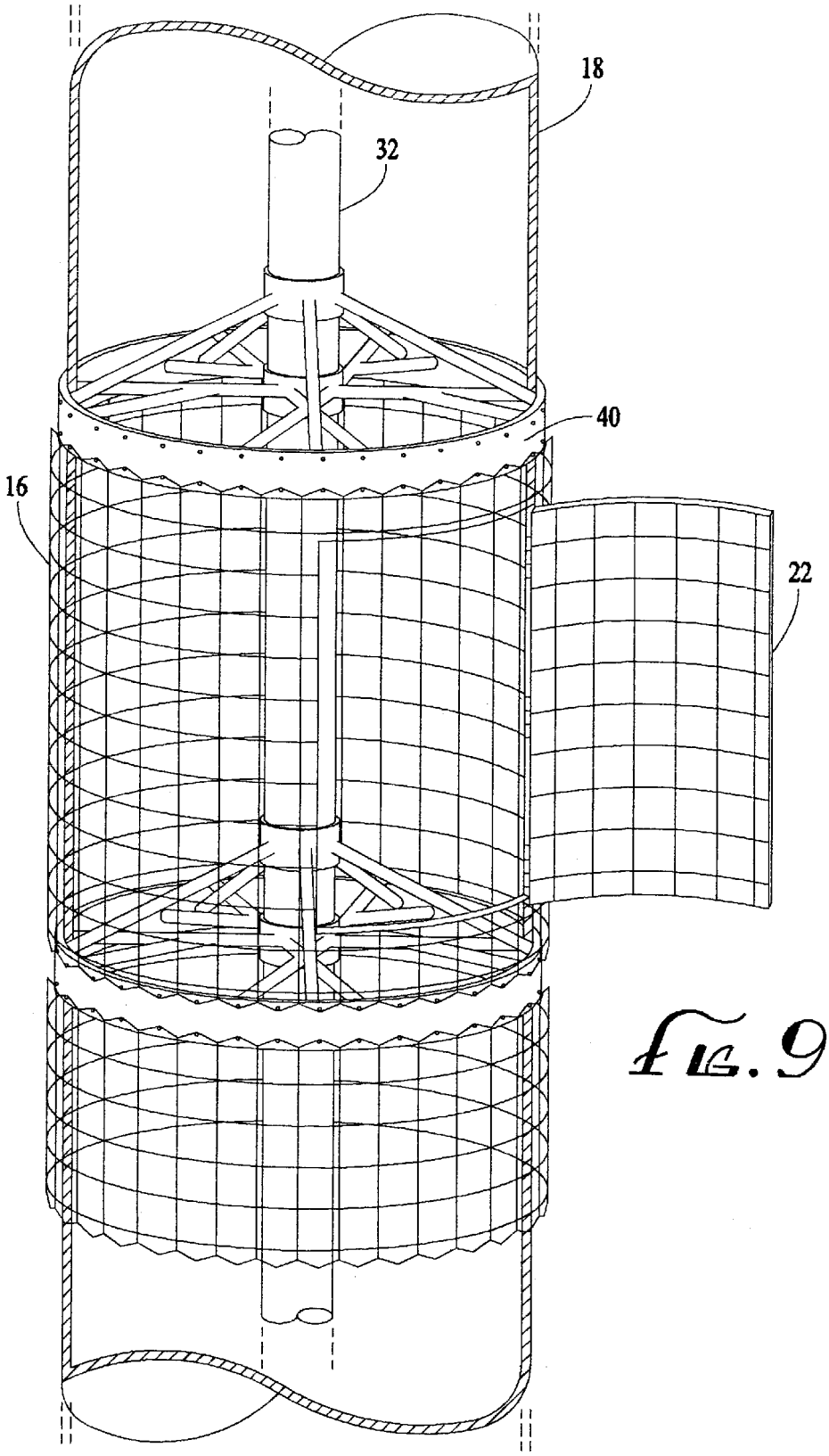
FIG. 9 is a detailed view of the support structure illustrated in FIG. 8.

FIG. 8 illustrates an embodiment similar to that which is illustrated in FIG. 7, except that an access door 22 has been provided in the tube 18 to provide convenient access to an antenna receptor member 20. FIG. 9 is a detailed view of this embodiment illustrated in FIG. 8 showing how the access door ("inspection door") 22 provides access through the support lattice 16 and through the tube 18 to the interior of the support lattice 16.

Figure 10:
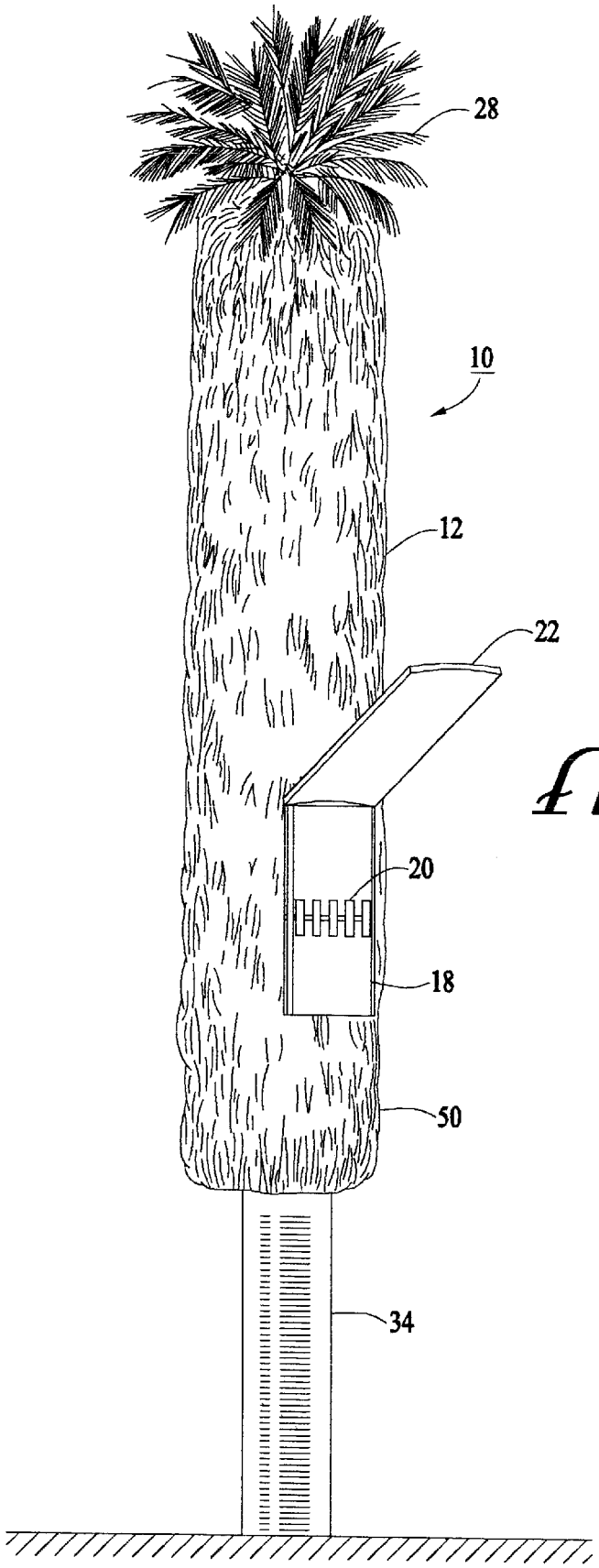
FIG. 10 is an isometric view of a fourth support structure having features of the invention.
Figure 11:
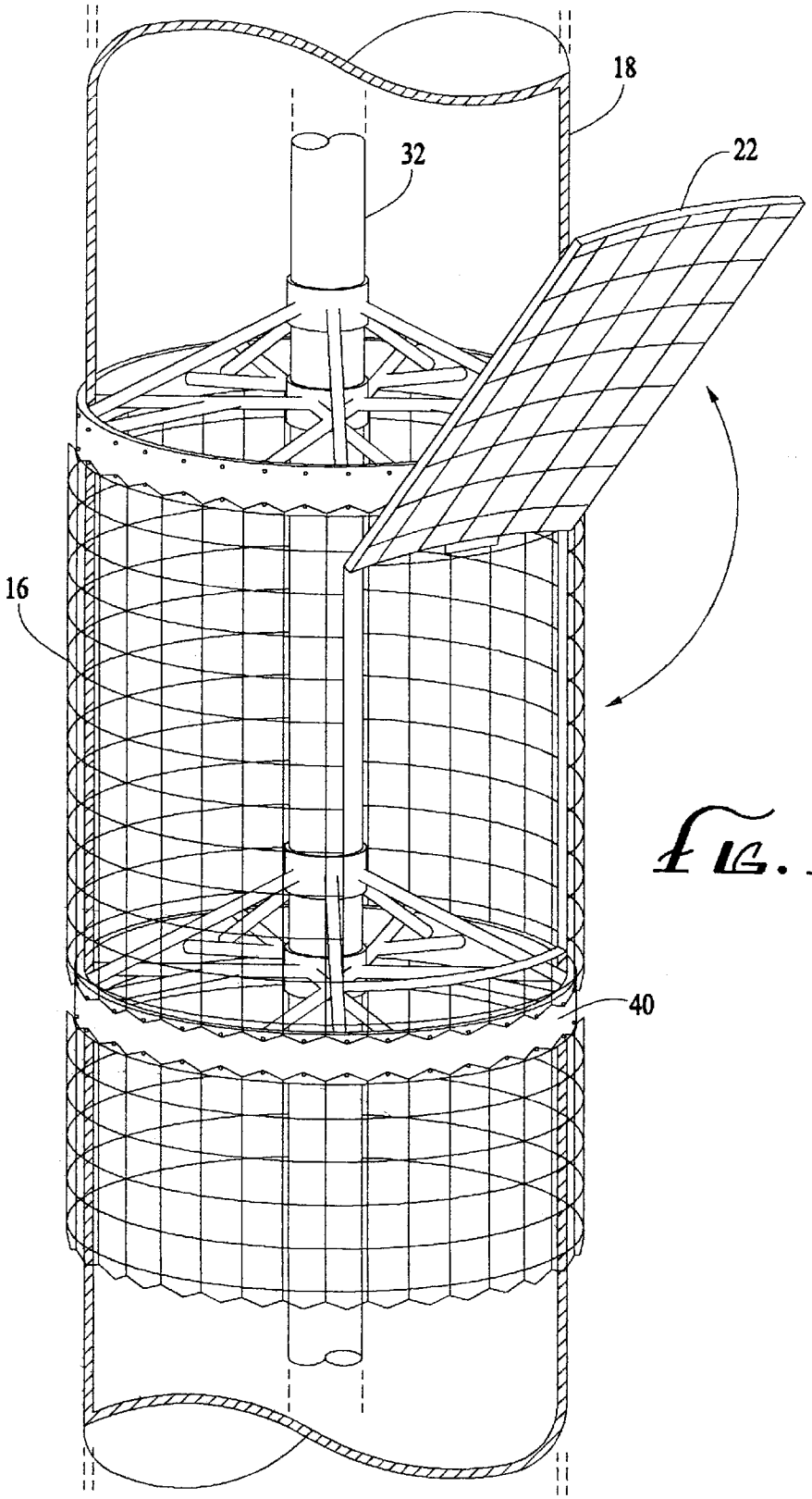
FIG. 11 is a detailed view of the support structure illustrated in FIG. 10.

FIGS. 10 and 11 illustrate a slightly different embodiment. In this embodiment, the access door 22 is hinged across the top of the opening, rather than along the side of the opening. This embodiment has the additional advantage of minimizing the chance that the access door 22 will be blown open in a strong wind.

FIGS. 12–15 illustrate yet another embodiment of the invention. In this embodiment, the support lattice 16 is replaced with a perforated cylinder 24 made from a material which is non-reflective to radio waves. The drooping members 12 are supported by the perforated cylinder 24 by being clipped with clips or otherwise attached within the perforations 26 in the cylinder 24.

Figure 16:
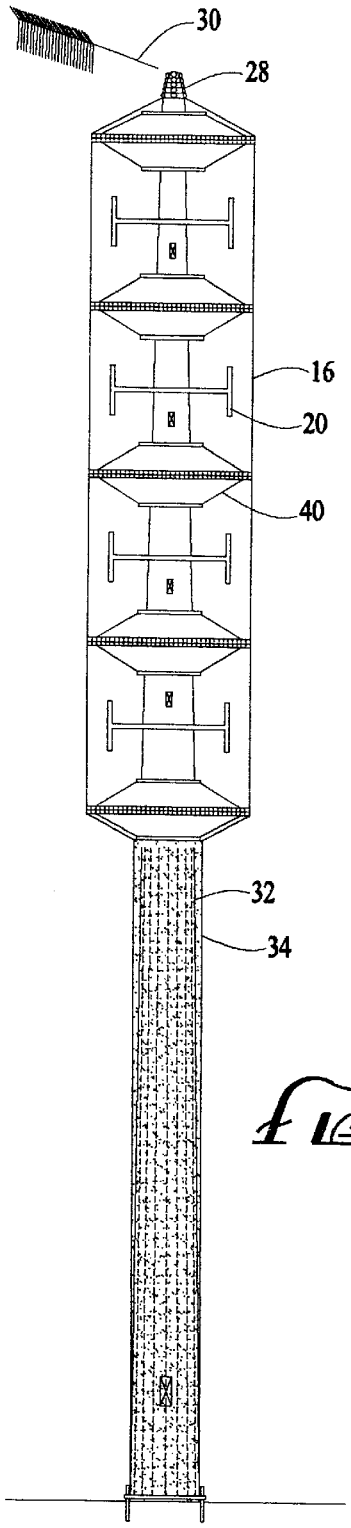
FIG. 16 is a side view of a sixth antenna support structure having features of the invention.
Figure 17:
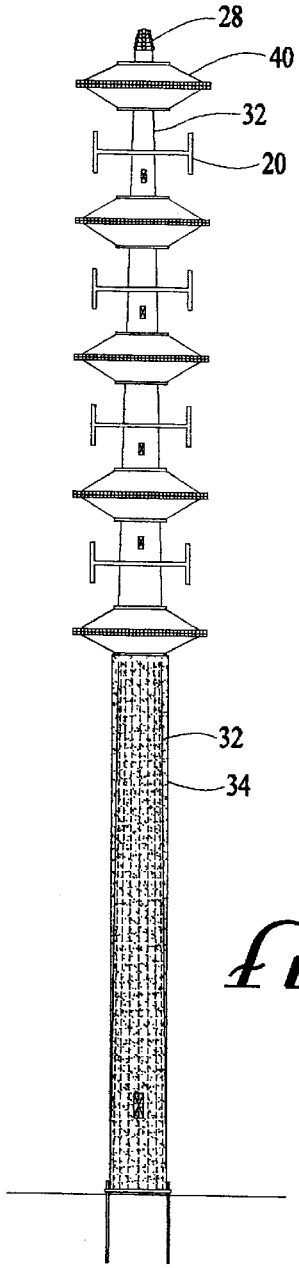
FIG. 17 is a side view of the support structure of FIG. 16, shown without the skirt portion.
Figure 18:
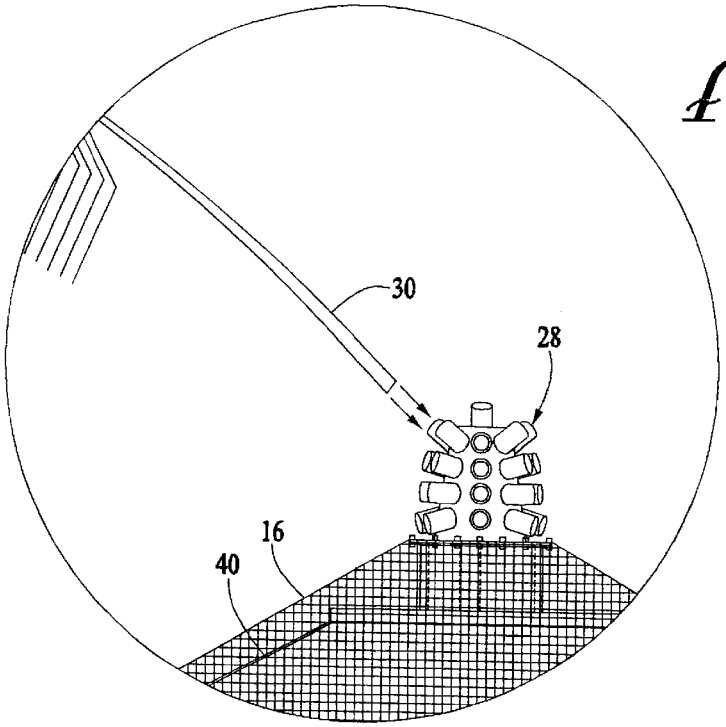
FIG. 18 is an isometric view of a top portion of the support structure illustrated in FIG. 16.
Figure 19:
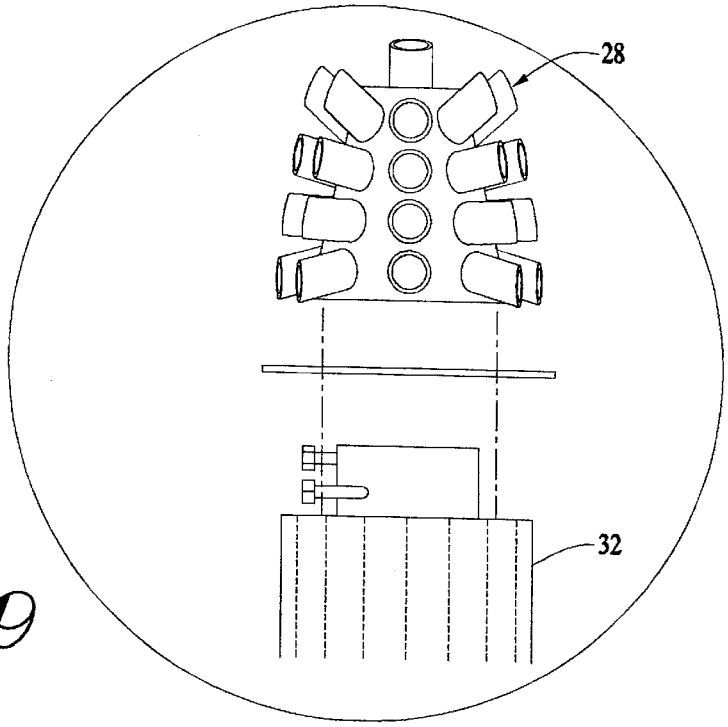
FIG. 19 is an isometric detail view of the top portion illustrated in FIG. 18.
Figure 20:
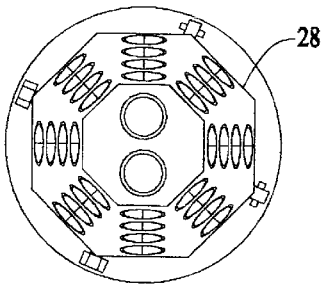
FIG. 20 is a plan view of the top portion of the support structure illustrated in FIG. 18.
Figure 21:
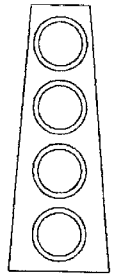
FIG. 21 is a detailed side view of a portion of the top portion illustrated in FIG. 18.
Figure 22:
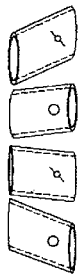
FIG. 22 is a detailed side view of a portion of the top portion illustrated in FIG. 18.

FIGS. 16–33 illustrate yet another embodiment of the invention. FIG. 16 illustrates this embodiment with the support lattice 16 in place. FIG. 17 illustrates this embodiment with the support lattice 16 removed. The support pole 32 is typically about 101.5 feet in height. Typically, support members 40 are about four feet in height and can be located on the support pole 32 between 47 feet and 51 feet, between 63 feet, 71 feet and 75 feet, between 83 feet and 87 feet, and between 95 feet and 99 feet, for example. Typically, two 10.5 inch by 25.5 inch coaxial exits are located at a height of approximately 7.5 feet on the support pole 32, three six inch by 12 inch coaxial inlets are located at a height of approximately 57 feet, three inlets are located at a height of approximately 65 feet, three inlets are located at a height of approximately 77 feet and three inlets are located at a height of approximately 89 feet.

FIGS. 18–22 illustrate the top portion 28 of the support structure 10 into which can be disposed green members 30 which typically are simulated green palm fronds. The top portion 28 can be a welded steel structure which is mechanically held in place atop the support pole ("monopole shaft") 32 with what can be stainless steel pins. In a typical embodiment, the top portion 28 is approximately 18 inches in height, 17 inches in width and is made from a one quarter inch thick hot roll steel material which has been galvanized with a green powder coat. The uppermost portion of the support lattice 16 can be mechanically anchored between the top portion 28 and the support pole 32. The green members 30 can be held in place by two stainless steel pins opposed to each other at 90°. Typically, the stainless steel pins are about one inch in diameter. In a typical embodiment, the green members 30 are disposed within the top portion 28 at a 15' offset for each column of green members 30. This replicates the natural placement found on a Washingtonia Filifera.

Figure 23:
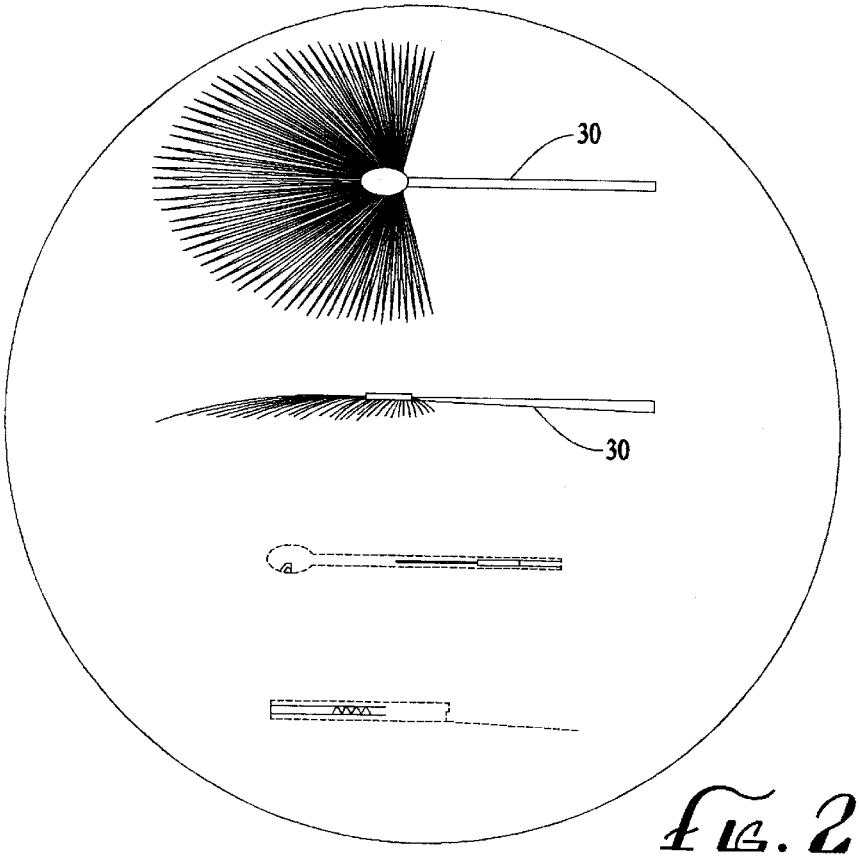
FIG. 23 consists of four detailed views of simulated palm fronds useable in the invention.

FIG. 23 illustrates four views of a typical green member 30 useable in the invention. Each of these green members 30 has the appearance of a palm frond. The frond can be made of materials that simulate natural movement of palm fronds in dynamic wind conditions. Such materials may include a polyurethane shaft to provide the linear and rotational flex found in natural palm fronds. Polyurethane also provides a "memory" ensuring that the shaft returns to its original shape after periods of great flexing. The fan portion of the green member 30 can be composed of acrylonitrile styrene acrylate, such as EASE's Loran S. Such materials ensure long-term weatherability for both structural integrity and color fastness. In a typical embodiment, the shaft portion is about 72 inches long and the front portion is about 67 inches long.

Figure 24:
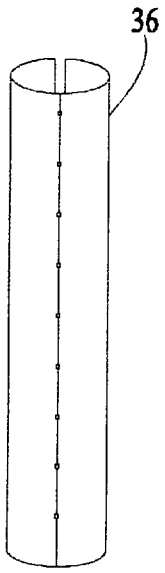
FIG. 24 is an inner portion of a base cover useable in the support structure illustrated in FIG. 16.
Figure 25:
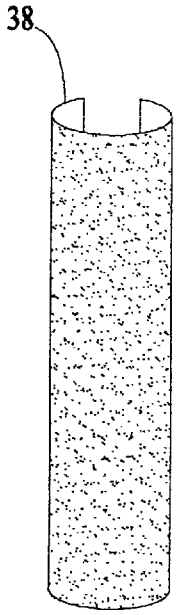
FIG. 25 is an outside portion of a base cover useable in the support structure illustrated in FIG. 16.
Figure 26:
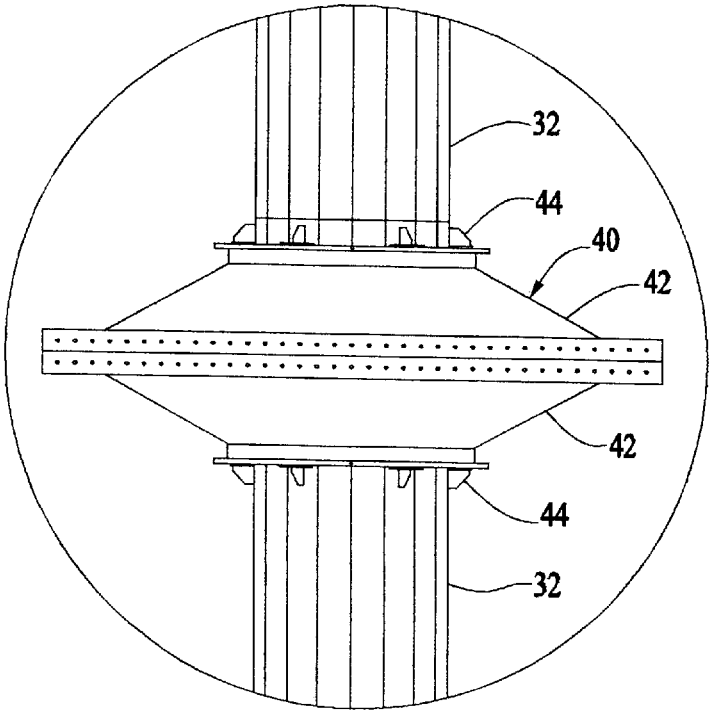
FIG. 26 is a side view of a support member useable in the support structure illustrated in FIG. 16.
Figure 30:
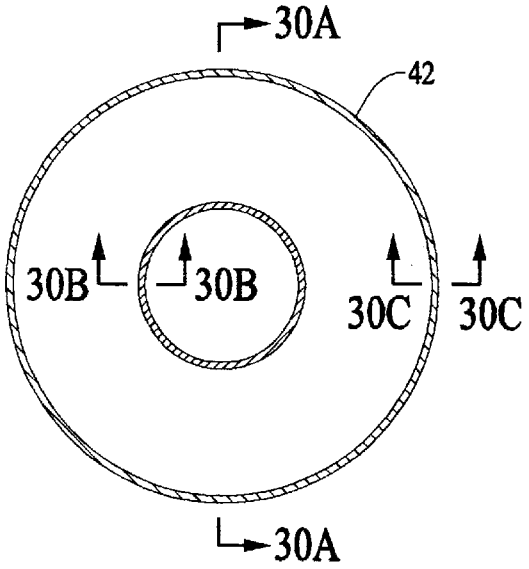
FIG. 30 is a detail view of the support member illustrated in FIG. 26.
Figure 30A:
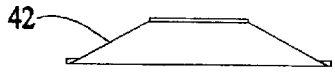
FIG. 30A is a further detail view of the support member illustrated in FIG. 30, taken along line 30A—30A.
Figure 30B:
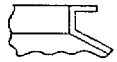
FIG. 30B is a further detail view of support member illustrated in FIG. 30, taken along line 30B—30B.
Figure 30C:
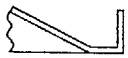
FIG. 30C is a further detail view detail view of the support member illustrated in FIG. 30, taken along line 30C—30C.
Figure 31:
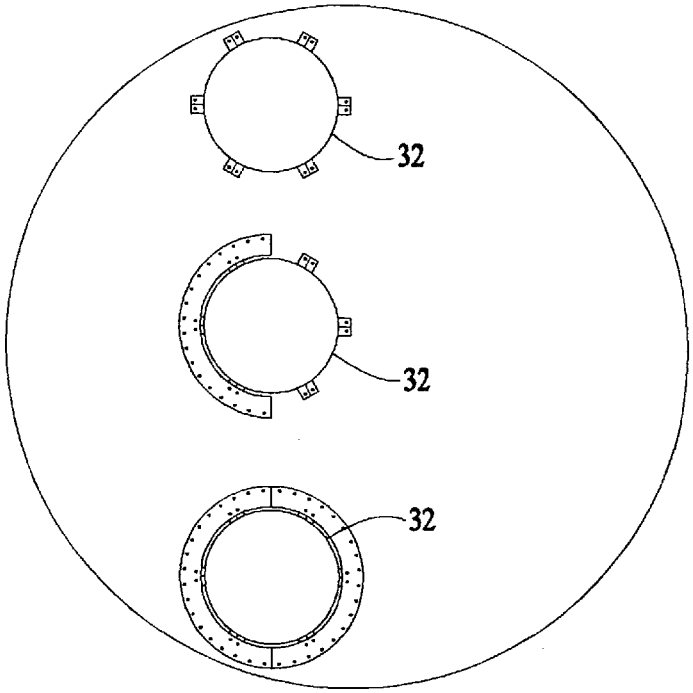
FIG. 31 consists of three cross-sectional views of the support structure illustrated in FIG. 17.

FIGS. 24 and 25 illustrate components of a typical base cover 34 useable in the invention. This base cover 34 comprises an inner member 36 made from a hinged pair of carbon steel members, such as members made from ⅛ inch hot rolled carbon steel. An outside member 38 is attached to the inner member 36. The outside member 38 is designed to simulate the base of a palm tree. In a typical embodiment, the outside member 38 can be made from a polyurethane (U.V. inhibited).

FIGS. 26–30 illustrate a support member 40 useable in this embodiment. The support member 40 is made from a pair of opposed fiberglass rings 42 which are assembled to one another using fiberglass nuts and bolts. Typically, the bolts are about ½ inch long and hexagonal. In a typical embodiment, 36 bolts are used in the support member 40. Typically, the support member is about four feet in height and each fiberglass ring 42 is about two feet in height. The top and bottom of the support members 40 typically are about 52 inches in diameter and the middle of the support member where the fiberglass rings 42 are attached is typically about 144 inches in diameter. The support member 40 is held in place on the support pole 32 by opposed sets of brackets 44 and half circle plates. These support members 40 are non-R.F. reflective.

Figure 32:
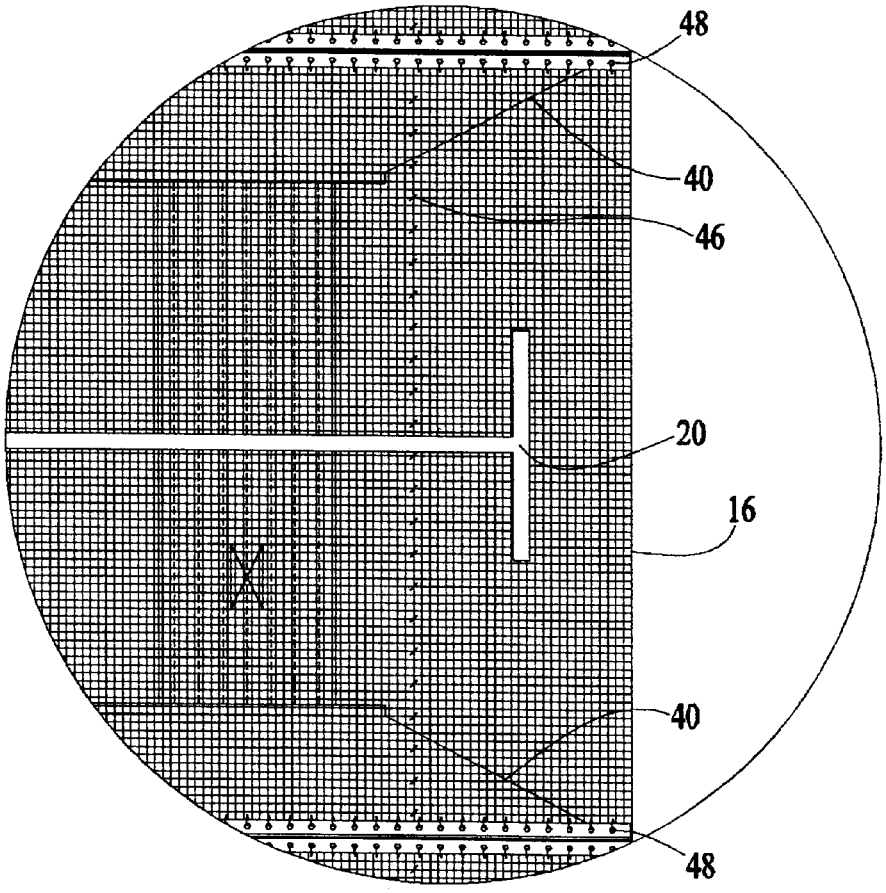
FIG. 32 is a detailed view of a support lattice useable in the invention.
Figure 33:
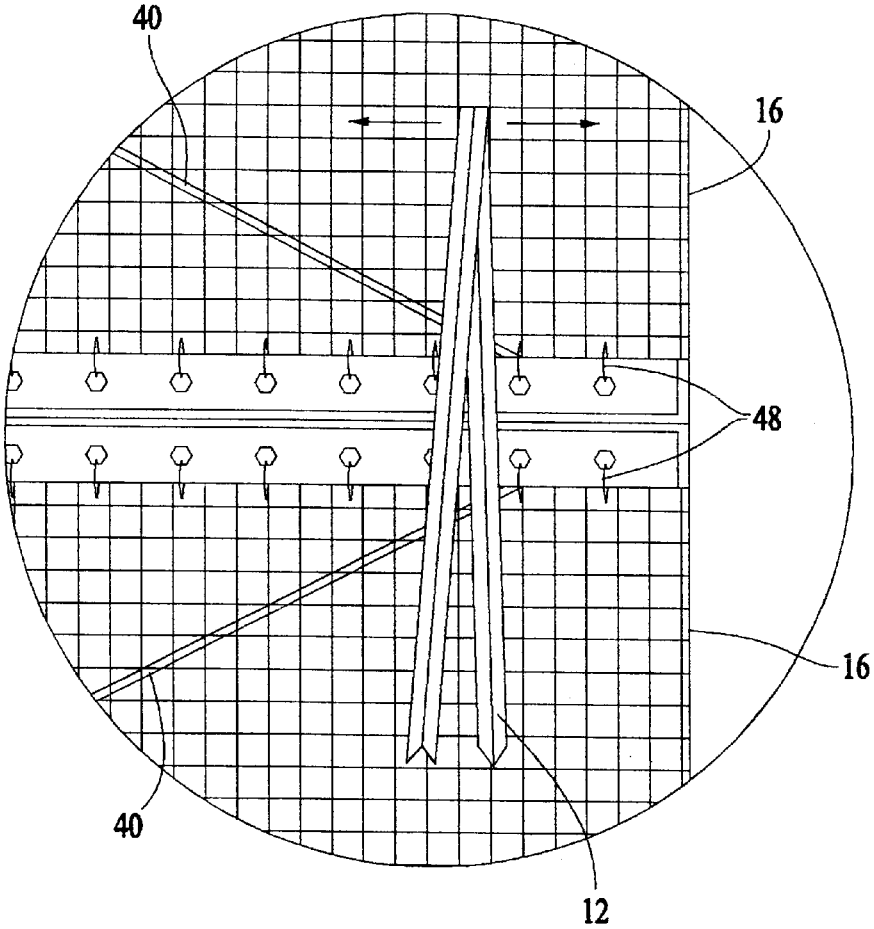
FIG. 33 is a second detailed view of a support lattice useable in the invention.

FIGS. 32 and 33 illustrate how the support lattice 16 is attached to the support member 40. As can be seen in the drawings, individual sections of support lattice 16 are supported at both the top and bottom by adjacent support members 40. By this design, the space between support members 40 is wholly enclosed in a "cage" having support lattice 16 for walls. This feature provides an important safety function, in that workers working between the support members 40 are prevented from falling off of the support pole 32 because of the enclosed "cage" provided by the cooperation of the adjoining support members 40 and the support lattice 16. As illustrated in FIG. 32, an access opening can be provided in the "cage" which can be closed and opened using access clips 46. The vertical openings can be disposed about every 12 feet along the circumference of the skirt. Each location can have three separate openings for easy access to all of the antenna receptor members 20.

A support lattice 16 is secured to the support members 40 by securing the lattice 10 to itself on vertical runs and to the support members 40 on horizontal runs using lattice support clips 48 which are non-R.F. reflective. Such lattice support clips 48 maintain the appearance of the uniform frond skirt and are easily opened and closed for antenna service.

The support lattice 16 can be a type 72 netting, with 1½ inch squares. Construction of the support lattice can be using 32 ends per mesh side of 840 denier nylon which is protruded with U.V. inhibitors for outdoor use. The breaking strength of such a support lattice 16 is about 864 pounds per strand (27 pounds per end). The circumference of the support lattice 16 is supported by a ¾ inch stranded nylon rope. Additional support can be provided by vertical lengths of ⅜ thick rope every two feet along the nettings 12 feet.

The drooping members 12 are composed of BASF's Loran S, ensuring the same structural and color fastness as the green fan fronds above the skirt. Each drooping member 12 is about five feet long and is folded in half over a strip of the support lattice 16 and adhered to itself. This creates a mechanical loop which is locked to the support lattice 16. The drooping members 12 are placed in horizontal rows spaced apart by about nine inches. This allows for better sind resistance. The ends of the drooping members 12 are frayed to better replicate a true frond skirt 50. Two similar but different colors are used to give the appearance of a naturally weathered frond skirt 50.

Having thus described the invention, it should be apparent that numerous structural modifications and adaptations may be resorted to without departing from the scope and fair meaning of the instant invention as set forth hereinabove.

What is claimed is:

1. An antenna support structure comprising:

(a) a vertical support pole having an upper portion, an intermediate portion and a lower portion, the lower portion being of a color and texture to resemble the trunk of a palm tree;

(b) a plurality of antenna receptor members disposed outwardly from the intermediate portion of the support pole;

(c) a plurality of green members disposed outwardly about the upper portion of the support pole, the plurality of green members having colors and textures to resemble new palm fronds; and (d) a plurality of drooping members disposed downwardly about the intermediate portion of the support pole, the plurality of drooping members having colors and textures to resemble a palm tree skirt;

wherein the vertical support pole comprises a plurality of support members and wherein a support lattice is attached to the plurality of support members;

wherein the cooperation of plurality of support members, the support lattice and the support pole form an enclosed cage; and wherein the plurality of drooping members are disposed on the support lattice and cover the antenna receptor members, so that the antenna support structure has the outward appearance of a palm tree.

2. The antenna support structure of claim 1 wherein access to the cage is provided by an opening which can be alternatively closed and opened.

3. The antenna support structure of claim 1 wherein the support lattice is made from a netting material.

4. The antenna support structure of claim 3 wherein the support lattice is made from a nylon material.

5. An antenna support structure comprising:

(a) a vertical support pole having an upper portion, an intermediate portion and a lower portion, the lower portion being of a color and texture to resemble the trunk of a palm tree;

(b) a plurality of antenna receptor members disposed outwardly from the intermediate portion of the support pole;

(c) a plurality of green members disposed outwardly about the upper portion of the support pole, the plurality of green members having colors and textures to resemble new palm fronds; and (d) a plurality of drooping members disposed downwardly about the intermediate portion of the support pole, the plurality of drooping members having colors and textures to resemble a palm tree skirt;

wherein the plurality of drooping members covers the antenna receptor members, so that the antenna support structure has the outward appearance of a palm tree;

wherein the vertical support pole comprises a plurality of support members and a support lattice attached to the plurality of support members, the plurality of drooping members being supported from the support lattice; and wherein the support lattice is provided by a netting material having vertical portions and horizontal portions and wherein the drooping members are folded over the horizontal portions.

6. The antenna support structure of claim 5 wherein the drooping members are retained on the support lattice by adhesives or by mechanical fasteners.

7. The antenna support structure of claim 1 further comprising a plastic tube attached to the support members, the plastic tube being disposed between adjoining support members and inside of the support lattice.

8. The antenna support structure of claim 7 wherein the plastic tube includes an access door.

9. The antenna support structure of claim 8 wherein the access door has a pair of opposed horizontal edges and a pair of opposed vertical edges, and wherein the access door is hinged to the plastic tube along one of the opposed vertical edges.

10. The antenna support structure of claim 1 wherein the access door has a pair of opposed horizontal edges and a pair of opposed vertical edges, and wherein the access door is hinged to the plastic tube along one of the opposed horizontal edges.

11. An antenna support structure comprising:

(a) a vertical support pole having an upper portion, an intermediate portion and a lower portion, the lower portion being of a color and texture to resemble the trunk of a palm tree;

(b) a plurality of antenna receptor members disposed outwardly from the intermediate portion of the support pole;

(c) a plurality of green members disposed outwardly about the upper portion of the support pole, the plurality of green members having colors and textures to resemble new palm fronds; and (d) a plurality of drooping members disposed downwardly about the intermediate portion of the support pole, the plurality of drooping members having colors and textures to resemble a palm tree skirt;

wherein the plurality of drooping members covers the antenna receptor members, so that the antenna support structure has the outward appearance of a palm tree;

wherein the vertical support pole comprises a plurality of support members and a support lattice attached to the plurality of support members, the plurality of drooping members being supported from the support lattice; and wherein the support lattice is a perforated cylinder.

* * * * *